US007800474B2

(12) United States Patent
Yabumi et al.

(10) Patent No.: US 7,800,474 B2
(45) Date of Patent: Sep. 21, 2010

(54) BOND MAGNET FOR DIRECT CURRENT REACTOR AND DIRECT CURRENT REACTOR

(75) Inventors: Takao Yabumi, Nagoya (JP); Koji Tsuru, Osaka (JP)

(73) Assignees: Daido Tokushuko Kabushiki Kaisha (JP); Kuretake Electro-Steel Co., Ltd. (JP)

( * ) Notice: Subject to any disclaimer, the term of this patent is extended or adjusted under 35 U.S.C. 154(b) by 0 days.

(21) Appl. No.: 12/388,187

(22) Filed: Feb. 18, 2009

(65) Prior Publication Data

US 2009/0206973 A1 Aug. 20, 2009

(30) Foreign Application Priority Data

Feb. 18, 2008 (JP) ..... 2008-035614
Dec. 5, 2008 (JP) ..... 2008-310354

(51) Int. Cl.
*H01F 21/00* (2006.01)

(52) U.S. Cl. ..... 336/110; 336/178

(58) Field of Classification Search ..... 336/110, 336/178; 148/105, 108
See application file for complete search history.

(56) References Cited

U.S. PATENT DOCUMENTS

| | | | | |
|---|---|---|---|---|
| 5,821,844 | A * | 10/1998 | Tominaga et al. | 336/110 |
| 6,319,334 | B1 * | 11/2001 | Ohashi et al. | 148/101 |
| 6,375,759 | B1 * | 4/2002 | Christenson et al. | 148/104 |
| 6,639,499 | B2 * | 10/2003 | Okita et al. | 336/110 |
| 2002/0117235 | A1 * | 8/2002 | Kanekiyo et al. | 148/101 |

FOREIGN PATENT DOCUMENTS

| | | |
|---|---|---|
| JP | 50-133453 | 10/1975 |
| JP | 2003-109832 | 4/2003 |
| JP | 2007-123596 | 5/2007 |

* cited by examiner

*Primary Examiner*—Anh T Mai
(74) *Attorney, Agent, or Firm*—Bacon & Thomas, PLLC

(57) ABSTRACT

The present invention provides a bond magnet for direct current reactor which is to be disposed in a gap formed in a magnetic core of a direct current rector, the bond magnet containing a magnet powder containing a rapidly quenched powder of a rare earth magnet alloy. The present invention also provides a direct current reactor including a magnetic core having a gap and a winding area wound around the magnetic core, in which the bond magnet is disposed in the gap of the magnetic core.

5 Claims, 2 Drawing Sheets

BOND MAGNET FOR DIRECT CURRENT REACTOR AND DIRECT CURRENT REACTOR

FIELD OF THE INVENTION

This invention relates to a bond magnet for direct current reactor and a direct current reactor.

BACKGROUND OF THE INVENTION

In a voltage conversion circuit in a DC-DC convertor and the like, for example, a direct current reactor has heretofore been used as an inductance part.

The direct current reactor has a magnetic core (core) that is made of a soft magnetic material and the like and may be varied in shape and a winding area that is wound around the magnetic core. A current that changes cyclically is ordinarily applied to the direct current reactor in a state where a direct current is biased.

The direct current reactor of the above-described type is required to have a constant inductance in a relatively wide operation electric current range. When the inductance is fluctuated, for example, a trouble such as a fluctuation in direct current voltage to be outputted occurs.

For the purpose of satisfying the above-described requirement, a gap has heretofore been formed in the magnetic core of the direct current reactor. By the formation of the gap in the magnetic core, a magnetic resistance of the magnetic core is increased to suppress magnetic saturation, thereby improving direct current superimposition characteristics of the reactor.

Also, in the gap, an insulation material such as glass epoxy material or the like is ordinarily used as a gap material, and a permanent magnet or the like may also be provided in some cases.

For instance, JP-A-2003-109832 discloses a magnetic core and an inductance part, wherein a bond magnet formed of a rare earth sintered magnet powder (coercive force: 3979 kA/m=50 kOe or more) and a resin is inserted into a gap formed on a magnetic path of the magnetic core.

Also, JP-A-50-133453 discloses an inductance element (reactor) that applies a magnetic bias by a permanent magnet that is inserted in a clearance of a magnet.

Also, JP-A-2007-123596 discloses a direct current reactor of a magnet bias type, wherein a permanent magnet is disposed so as to generate a bias magnetic field, whereby a magnetic flux formed by a coil and a magnetic flux formed by the permanent magnet cancel each other out.

However, the conventional techniques have the following problems.

In the case where the permanent magnet is disposed in the gap of the magnetic core in the direct current reactor, the direct current superimposition characteristics are improved. Such an improvement is achieved since the magnetic saturation of the magnetic core is alleviated by the bias magnetic field generated by the magnet.

However, such an effect is exhibited only when the magnetic force of magnet that decides the size of the bias magnetic field is stabilized in a use temperature range of the reactor.

Although the above-described effect is expected by the direct current reactor in which the permanent magnet is disposed in the gap of the magnetic core, a product has not yet been provided in actuality as a reactor to which a high electric current is applied. Therefore, under a current situation, the direct current reactor in which the gap material such as glass epoxy resin is disposed in the gap of the magnetic core is the mainstream product.

Reasons for the above-described current situation include disappearance of the magnet-based bias effect due to irreversible demagnetization of the permanent magnet by heat caused in a temperature range (for example, from about −40° C. to about 150° C.) at which the direct current reactor is usually used and the like.

As disclosed in JP-A-2003-109832, it is considered that the above problem may be solved by using a sintered magnet powder having a remarkably large coercive force (about 3979 kA/m).

However, a relationship between a coercive force (iHc) and a residual magnetic flux density (Br) of rare earth magnet is so-called a trade-off relationship in which one of them is reduced when the other one is increased.

Accordingly, in the case that the above-described large coercive force is set to about 3979 kA/m, it is difficult to keep the residual magnetic flux density to 0.25 T or more, so that it is difficult to ensure a residual magnetic flux density required for generating a sufficient bias magnetic field. Therefore, it is considered that it is difficult to actually achieve improvement in direct current superimposition characteristics.

Consequently, it is considered to use a sintered magnet powder having a coercive force that is required from the practical point of view. However, according to the investigations made by the inventors, it was revealed that sufficient bias magnetic field is not generated and a problem of an increase in noise during use of the direct current reactor occurs with the use of such sintered magnet powder.

In JP-A-50-133453, demagnetization of the magnet at a temperature in actual use and in a diamagnetic field is not fully considered. Also, in JP-A-2007-123596, since it is difficult to effectively bias the magnetic flux of a magnet, a stronger magnet is required to thereby cause an increase in size of the reactor. Further, since it is difficult to generate the appropriate bias magnetic field, it is considered that it is impossible to achieve an effect of reducing noise.

SUMMARY OF THE INVENTION

This invention has been accomplished in view of the above-described problems, and an object thereof is to provide a bond magnet that is used as a gap material of a direct current reactor and capable of reducing a noise of the direct current reactor. Another object of this invention is to provide a direct current reactor using the bond magnet.

In order to solve the above-described problems, the inventors had conducted various investigations. As a result, the inventors found that the use of rapidly quenched powder of a rare earth magnet alloy as a magnet powder forming a bond magnet to be used for a gap material of a direct current reactor makes it possible to achieve a high coercive force that eliminates magnet demagnetization otherwise generated by heat and a diamagnetic field and to achieve a high residual magnetic flux density that enables applying a sufficient bias magnetic field and obtaining an effect of reducing noise to be generated.

This invention has been accomplished based on the above-described findings, and according to this invention, there is provided a bond magnet for direct current reactor which is to be disposed in a gap formed in a magnetic core of a direct current rector, the bond magnet containing a magnet powder containing a rapidly quenched powder of a rare earth magnet alloy.

The rare earth magnet alloy may preferably be at least one member selected from the group consisting of a R—X1-X2 magnet alloy (wherein R is at least one rare earth element selected from the group consisting of Nd, Pr, Dy, Tb, and Ho, X1 is at least one element selected from the group consisting of Fe and Co, and X2 is at least one element selected from the group consisting of B and C); a Sm—Fe—N magnet alloy; and a Sm—Co magnet alloy.

In the bond magnet for direct current reactor, a residual magnetic flux density may preferably be within a range of from 20% to 100% of a saturated magnetic flux density of the magnetic core used for the direct current reactor, and a coercive force may preferably be within a range of from 800 to 3200 kA/m.

In the bond magnet for direct current reactor, recoil permeability may preferably be 1.1 or more.

Additionally, according to this invention, there is also provided a direct current reactor including a magnetic core having a gap and a winding area wound around the magnetic core, in which the above-described bond magnet for direct current reactor is disposed in the gap of the magnetic core.

The bond magnet for direct current reactor according to this invention is a permanent magnet to be disposed in a gap formed in a magnetic core of a direct current reactor. A magnet powder forming the magnet is composed of a rapidly quenched powder of a rare earth magnet alloy.

Such a rapidly quenched powder does not undergo a high temperature sintering process in powder production. Therefore, the rapidly quenched powder is formed of fine crystal grains as compared to a sintered powder in which crystal grains tend to become crude due to a sintering process.

Therefore, as compared to a sintered powder, the rapidly quenched powder is suppressed in reduction in coercive force under the environment of a relatively high temperature and capable of easily realizing a relatively high residual magnetic flux density. Further, since a temperature coefficient of the residual magnetic flux density is as low as −0.1%/° C. or less, it is possible to maintain high residual magnetic flux density and coercive force under high temperature environment.

Consequently, use of the bond magnet according to this invention, which contains the magnet powder containing the rapidly quenched powder, as the gap material of the direct current reactor makes it possible to suppress thermal demagnetization of the magnet as well as to achieve a large bias effect of a coil magnetic flux by a magnetic flux of magnet. That is, the bond magnet is capable of achieving both of demagnetization resistance and a magnet bias effect in the use environment.

Therefore, as compared to the case of using a bond magnet in which a sintered powder is used as a gap material, the case where glass epoxy resin or the like is used as the gap material, and the like, it is possible to reduce noise of the reactor during use since it is possible to apply a bias magnetic field that is sufficient for cancelling noise.

Also, with the above-described usage, it is possible to simultaneously improve inductance characteristics of the direct current reactor.

It is possible to further reduce the noise in the case where the residual magnetic flux density of the bond magnet for direct current reactor is within the range of 20% to 100% of a saturated magnetic flux density of the magnetic core used in the direct current reactor and the coercive force is within the range of from 800 to 3200 kA/m.

In the case where recoil permeability of the bond magnet for direct current reactor is 1.1 or more, it is possible to improve the inductance characteristics of the direct current reactor, and it is possible to downsize the direct current reactor along with improvement in direct current superimposition characteristics.

In the direct current reactor according to this invention, the above-described bond magnet for direct current reactor is disposed in a gap of a magnetic core.

Therefore, it is possible to reduce an in-gap vibration which is the main cause of the noise and proportional to the size of a magnetic field magnetic flux as well as the size of the magnetic field magnetic flux caused by a magnet bias action, thereby making it possible to reduce the noise as compared to conventional direct current reactors.

BEST MODE FOR CARRYING OUT THE INVENTION

Figure 1:
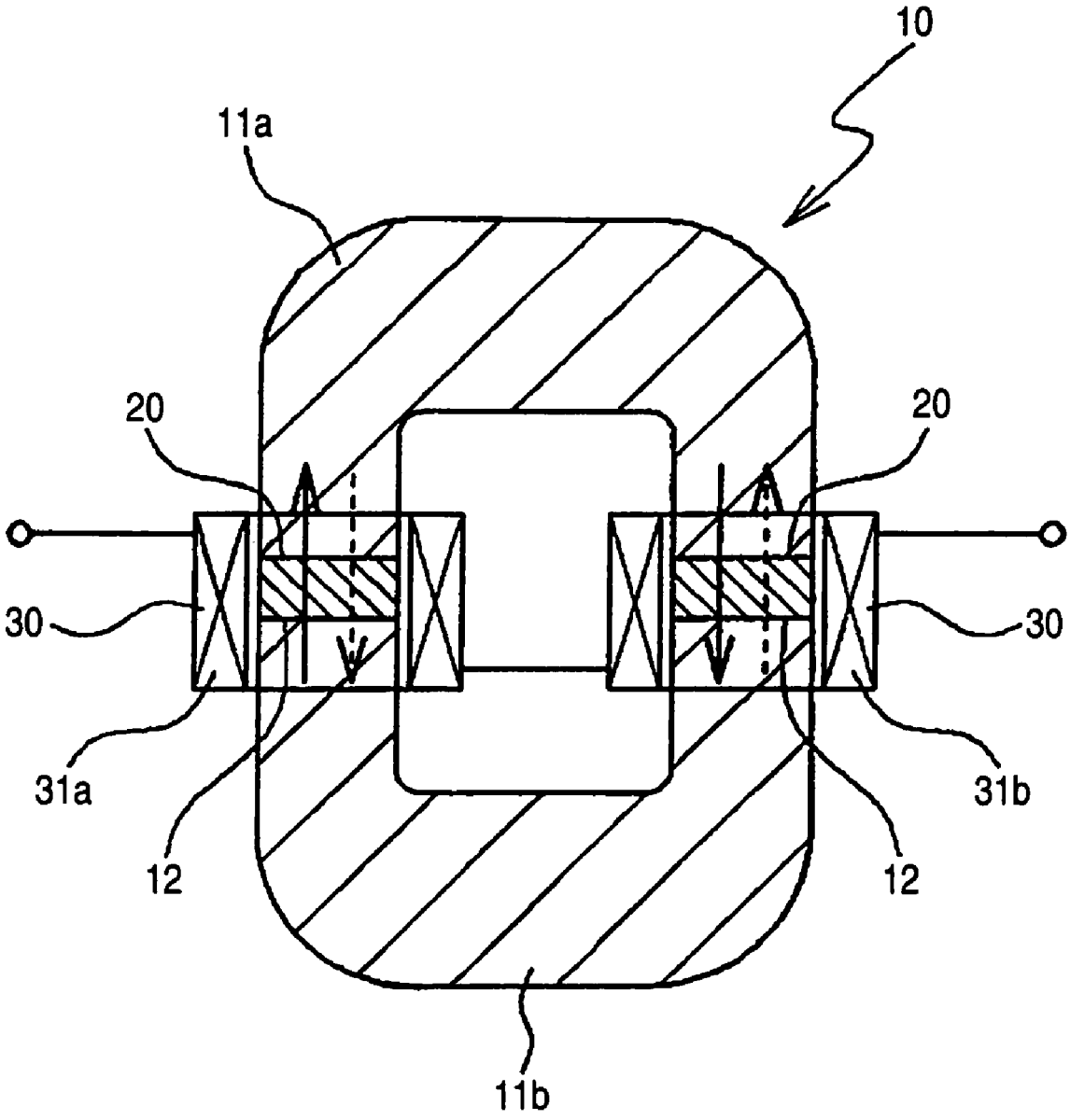
FIG. 1 is a front view showing a schematic structure of a direct current reactor produced in Examples.

Hereinafter, a bond magnet for direct current reactor according to one embodiment of this invention (hereinafter sometimes referred to as "the present bond magnet") and a direct current reactor according to one embodiment of this invention (hereinafter sometimes referred to as "the present reactor") will be described in detail.

The present reactor has a magnetic core (core) and a winding area in which a winding wire is wound around the magnetic core for at least one turn. The magnetic core has a gap in a magnetic path, and the present bond magnet is disposed in the gap.

In the present reactor, a gap length is not particularly limited However, when the gap length is too small, there is a tendency that it is difficult to achieve desired direct current superimposition characteristics. In contrast, when the gap length is too large, there is a tendency that it is difficult to achieve a desired inductance value due to a reduction in total magnetic permeability in the magnetic path. It is possible to appropriately set the gap length in view of these tendencies.

Therefore, a shape of the present bond magnet is decided depending on a shape of the gap of the present reactor and is not particularly limited.

The present bond magnet is disposed in the gap in such a way as to generate a magnetic flux in a direction reverse to a magnetic flux generated by the winding area.

In the present reactor, a shape of the magnetic core is not particularly limited, and it is possible to adapt various shapes such as a substantially annular shape, a substantially F-shape, a substantially U-shape, or the like. Specific examples of the material for the magnetic core include a Fe electromagnetic steel plate containing a several percentages of Si (e.g. 1 mass % or more), an amorphous electromagnetic steel plate, and a powder magnetic core.

The present bond magnet contains a specific magnet powder and a binder for binding the magnetic powder.

One of the great characteristics of the present bond magnet is the use of a rapidly quenched powder of a rare earth magnet alloy as the magnet powder forming the bond magnet. A rapid quenching method in general is a method for obtaining a rapidly quenched powder by bringing a molten magnet component into contact with a cooled rotational roll (single roll or the like) and solidifying the magnet component by rapid quenching.

In comparison between the sintered powder that underwent the high temperature sintering process in the powder production and the rapidly quenched powder, there is a difference in microstructure that the sintered powder has crude crystal grains due to sintering while the rapidly quenched powder has fine crystal grains due to the rapid quenching.

Therefore, the rapidly quenched powder is suppressed in reduction of coercive force under a relatively high temperature environment as compared to the sintered powder. It is assumed that, even when one crystal grain is brought to magnetization reversal, a crystal grain boundary positioned outside the crystal grain inhibits propagation of the magnetization reversal due to the fineness of the crystal grains, thereby avoiding complete magnetization reversal of the whole crystal grains.

As described above, since the rapidly quenched powder has a small reduction in coercive force at high temperatures, it is possible to maintain a high residual magnetic flux density under a relatively low temperature environment such as at a room temperature as compared to the sintered powder.

Since the rapidly quenched powder is used for the present bond magnet, the magnet is hardly or never demagnetized by heat even when a temperature becomes relatively high within the ordinary use temperature range during use of the reactor, and the bias effect of the coil magnetic flux due to the magnet magnetic flux is increased, thereby making it possible to contribute to the reduction in noise.

An average grain diameter of the magnet powder may preferably be 10 to 500 μm, more preferably 100 to 300 μm, from the view points of improvement in filling density and the like. It is possible to measure the average grain diameter in accordance with an observation using a scanning electron microscope (SEM).

In the present bond magnet, the type of the magnet alloy forming the magnet powder may preferably be a rare earth magnet alloy.

Specifically, as the rare earth magnet alloy, a R—X1-X2 magnet alloy (in which R is at least one rare earth element selected from the group consisting of Nd, Pr, Dy, Tb, and Ho, X1 is at least one element selected from the group consisting of Fe and Co, and X2 is at least one element selected from the group consisting of B and C), a Sm—Fe—N magnet alloy, a Sm—Co magnet alloy, and the like may suitably be used.

In view of a relatively high saturated magnetization, a strong magnetic force, and the like, a Nd—Fe—B magnet alloy, a Sm—Fe—N magnet ally, a Sm—Co magnet alloy, and the like may preferably be used. Particularly, the Sm—Fe—N magnet alloy and the Sm—Co magnet alloy are useful due to their excellent corrosion resistance and heat resistance. The rapidly quenched powder in the present bond magnet may be formed of one kind of alloy powder or may be formed of a combination of two or more kinds of different alloy powders.

Also, the residual magnetic flux density of the present bond magnet may preferably be within the range of 20% to 100% of the saturated magnetic flux density of the magnetic core used in the direct current reactor. When the residual magnetic flux density is within the above-specified range, it is possible to readily suppress the vibration generated in the gap by the magnet bias that is appropriate for use. The saturated magnetic flux density may more preferably be 25% or more, further preferably 30% or more, most preferably 35% or more from the reasons described above.

A coercive force of the present bond magnet may preferably be within the range of from 800 to 3200 kA/m. When the coercive force is 800 kA/m or more, demagnetization hardly or never occurs in the high temperature use region, and it is possible to readily obtain the sufficient direct current superimposition characteristics. Also, when the coercive force is 3200 kA/m or less, it is possible to easily maintain a high residual magnetic flux density under the relatively low temperature environment. The coercive force may more preferably be 1200 kA/m or more, further preferably 1500 kA/m or more, from the reasons described above. The coercive force may more preferably be 2800 kA/m or less, further preferably 2400 kA/m or less, yet more preferably 2000 kA/m or less, most preferably 1800 kA/m or less, from the reasons described above.

When the residual magnetic flux density and the coercive force of the present bond magnet are within the above-specified ranges, it is possible to further reduce the noise. It is possible to measure the residual magnetic flux density and the coercive force using a BH analyzer after formation of the bond magnet.

Recoil permeability of the present bond magnet may preferably be 1.1 or more, more preferably 1.15 or more, further preferably 1.2 or more. When the recoil permeability is within the above-specified range, it is possible to improve the inductance characteristics of the present reactor as well as to achieve downsizing of the present reactor along with the improvement in direct current superimposition characteristics. It is possible to detect the recoil permeability from the measurement results using a BH analyzer.

In the present bond magnet, a content of the magnet powder may preferably be within the range of from 80 to 97 mass %, more preferably from 90 to 97 mass %, further preferably from 94 to 97 mass %. This is because, within such a range, a balance between magnetic characteristics and a cost and the like are favorable.

In the present bond magnet, a binder that is a constituent part other than the magnet powder is not particularly limited.

The binder may be a hard type (rigid type) or may be a soft type (flexible type). It is possible to select the binder in view of mechanical strength, flexibility, and the like that are required depending on the usage.

Specific examples of the binder material include various resins and rubbers.

Specific examples of the resins include various thermosetting resins (an epoxy resin, a phenol resin, and the like), and various thermoplastic resins (olefin resins such as polypropylene and polyethylene; polyamide resins; polyvinyl chloride resins; and the like). Specific examples of the rubbers include a nitrile rubber, an isoprene rubber, an acryl rubber, a fluorine rubber, a butadiene rubber, and a natural rubber. These may be used alone or in combination of two or more thereof.

The following method is suitably employed for producing the present bond magnet described above, for example.

A rapidly-quenched powder is produced by rapidly quenching a molten metal of a rare earth magnet alloy, followed by pulverization. More specifically, a molten alloy of a rare earth magnet component having a predetermined chemical composition is prepared, and, after rapidly quenching the molten alloy by dropping the molten alloy on a surface of a single roll rotating at a predetermined rim speed, pulverization is performed to produce the rapidly-quenched powder. In this case, pulverization, classification, and the like may be performed after the rapid solidification as required. In the rapid quenching method, it is possible to adjust a crystal grain diameter of the powder to be obtained by changing the roll rim speed.

Subsequently, the thus-obtained rapidly powder and a binder material are so mixed as to satisfy a predetermined composition, followed by sufficient kneading. When so required, one or more types of additives such as a coupling agent and a lubricant may be added. Also, it is possible to mix rapidly quenched powders having different alloy compositions.

The thus-obtained mixture is molded by employing an optimal molding method in view of a shape to be formed, the material of the binder, and the like. Specific examples of the molding method include press molding, injection molding, extrusion molding, and roll molding. As the occasion demands, such as in the case where the thermosetting resin is used, it is possible to perform heating at an optimal temperature for the materials.

Subsequently, magnetization is performed on the obtained molded article to obtain the present bond magnet.

EXAMPLES

Hereinafter, this invention will be described in more details by using examples.

1. Production of Bond Magnet for Direct Current Reactor (Gap Material)

Example 1B

Raw materials were weighed to achieve a magnet alloy composition of Nd: 30.4 mass %, Fe: 62.0 mass %, Co: 6.00 mass %, B: 0.91 mass %, Ga: 0.56 mass %, and inevitable impurities: 0.13 mass %, and the weighed materials were heated and molten to obtain a molten alloy.

Subsequently, the thus-obtained molten alloy was rapidly solidified by using the single roll rapid quenching method to prepare a rapidly quenched powder having the above-described magnet alloy composition (average grain diameter: 200 μm). A roll rim speed was 25 m/s.

Subsequently, 97 mass % of the thus-obtained rapidly quenched powder and 3 mass % of an epoxy resin serving as a binder were mixed.

Subsequently, the thus-obtained mixture was molded into a rectangular parallelepiped article having a thickness of 1 mm, a length of 25 mm, and a width of 16 mm by employing press molding. After that, a hardening treatment was performed in an argon atmosphere at 170° C. for one hour, followed by magnetization in a pulse magnetic field, thereby obtaining a bond magnet according to Example 1B.

The thus-obtained bond magnet had a residual magnetic flux density of 0.65 T, a coercive force of 1650 kA/m, and a recoil permeability of 1.2.

Example 2B

Raw materials were weighed to achieve a magnet alloy composition of Sm: 19.3 mass %, Fe: 72.0 mass %, N: 3.1 mass %, and inevitable impurities: 5.6 mass %, and the weighed materials were heated and molten to obtain a molten alloy.

A bond magnet according to Example 2B was obtained in the same manner as in the bond magnet production according to Example 1B except for using the molten alloy of the magnet alloy composition prepared in Example 2B. The bond magnet according to Example 2B had a residual magnetic flux density of 0.75 T and a coercive force of 1220 kA/m.

Example 3B

Raw materials were weighed to achieve a magnet alloy composition of Sm: 30.0 mass % and Co: 70.0 mass %, and the weighed materials were heated and molten to obtain a molten alloy.

A bond magnet according to Example 3B was obtained in the same manner as in the bond magnet production according to Example 1B except for using the molten alloy of the magnet alloy composition prepared in Example 3B. The bond magnet according to Example 3B had a residual magnetic flux density of 0.60 T and a coercive force of 1350 kA/m.

Example 4B

Raw materials were weighed to achieve a magnet alloy composition of Nd: 23.4 mass %, Fe: 62.1 mass %, Co: 6.00 mass %, B: 0.91 mass %, Dy: 7 mass %, Ga: 0.56 mass %, and inevitable impurities: 0.13 mass %, and the weighed materials were heated and molten to obtain a molten alloy.

A bond magnet according to Example 4B was obtained in the same manner as in the bond magnet production according to Example 1B except for using the molten alloy of the magnet alloy composition prepared in Example 4B. The bond magnet according to Example 4B had a residual magnetic flux density of 0.35 T and a coercive force of 3300 kA/m.

Comparative Example 1B

Raw materials were weighed to achieve a magnet alloy composition of Nd: 20.3 mass %, Pr: 5.85 mass %, Dy: 5.12 mass %, Fe: 66.4 mass %, Co: 0.98 mass %, B: 0.94 mass %, and inevitable impurities: 0.41 mass %, and the weighed materials were heated and molten to obtain a molten alloy.

Subsequently, the thus-obtained molten alloy was casted by employing strip casting, followed by hydrogen absorption, and a powder (average grain diameter: 200 μm) was obtained by pulverization.

Subsequently, the powder was subjected to press molding in a magnetic field, followed by sintering in an argon atmosphere at 1000° C., and a sintered powder (average grain diameter: 200 μm) formed of the above-described magnet alloy composition was prepared by pulverization.

Subsequently, 97 mass % of the thus-obtained sintered powder and 3 mass % of an epoxy resin serving as a binder were mixed.

Subsequently, the thus-obtained mixture was molded into a rectangular parallelepiped article having a thickness of 1 mm, a length of 25 mm, and a width of 16 mm by employing press molding. After that, a hardening treatment was performed in an argon atmosphere at 170° C. for one hour, followed by magnetization in a pulse magnetic field, thereby obtaining a bond magnet according to Comparative Example 1B. The bond magnet according to Comparative Example 1B had a residual magnetic flux density of 0.45 T and a coercive force of 1610 kA/m.

Comparative Example 2B

Raw materials were weighed to achieve a magnet alloy composition of Nd: 26.3 mass %, Pr: 0.05 mass %, Dy: 3.30 mass %, Tb: 0.89 mass %, Fe: 64.9 mass %, Co: 2.44 mass %, B: 0.94 mass %, and inevitable impurities: 1.18 mass %, and the weighed materials were heated and molten to obtain a molten alloy.

A bond magnet according to Comparative Example 2B was obtained in the same manner as in the bond magnet production according to Comparative Example 1B except for using the molten alloy of the magnet alloy composition prepared in Comparative Example 2B. The bond magnet according to Comparative Example 2B had a residual magnetic flux density of 0.50 T and a coercive force of 1440 kA/m.

The production methods, compositions, residual magnetic flux densities (Br), and coercive forces (iHc) of Examples 1B, 2B, 3B, and 4B and Comparative Examples 1B and 2B are summarized in Table 1.

TABLE 1

| Example/ Comparative Example | Powder Production Method | Composition (mass %) Nd | Sm | Fe | B | N | Co | Others | Residual Magnetic Flux Density: Br (T) | Coercive Force: iHc (kA/m) |
|---|---|---|---|---|---|---|---|---|---|---|
| Example 1B (Nd—Fe—B) | Rapid Quenching | 30.4 | — | 62.0 | 0.91 | — | 6.00 | Ga: 0.56 mass % Inevitable Impurities: 0.13 mass % | 0.65 | 1650 |
| Example 2B (Sm—Fe—N) | Rapid Quenching | — | 19.3 | 72.0 | — | 3.1 | — | Inevitable Impurities: 5.6 mass % | 0.75 | 1220 |
| Example 3B (Sm—Co) | Rapid Quenching | — | 30.0 | — | — | — | 70.00 | — | 0.60 | 1350 |
| Example 4B (Nd—Fe—B) | Rapid Quenching | 23.4 | — | 62.1 | 0.91 | — | 6.0 | Dy: 7 mass % Ga: 0.56 mass % Inevitable Impurities: 0.13 mass % | 0.35 | 3300 |
| Comparative Example 1B (Nd—Fe—B) | Sintering | 20.3 | — | 66.4 | 0.94 | — | 0.98 | Pr: 5.85 mass % Dy: 5.12 mass % Inevitable Impurities: 0.41 mass % | 0.45 | 1610 |
| Comparative Example 2B (Nd—Fe—B) | Sintering | 26.3 | — | 64.9 | 0.94 | — | 2.44 | Pr: 0.05 mass % Dy: 3.30 mass % Tb: 0.89 mass % Inevitable Impurities: 1.18 mass % | 0.50 | 1440 |

Comparative Example 3

A glass epoxy resin molded into a rectangular parallelepiped article having a thickness of 1 mm, a length of 25 mm, and a width of 16 mm was used as a gap material according to Comparative Example 3.

2. Production of Direct Current Reactor

Examples 1R, 2R, 3R, and 4R

A pair of cut cores (magnetic path section: 25 mm×16 mm; average magnetic path length: 227 mm; semi-annular shape) on each of which a Fe plate (thickness: 0.1 mm) containing 6.5 mass % of Si was laminated were opposed to each other in such a way that a gap having a width of 1 mm was formed, and the bond magnet according to each of Examples 1B, 2B, 3B, and 4B was inserted into and bonded to the gap to produce a substantially annular magnetic core.

A saturated magnetic flux density of the cut core (magnetic core) that was measured by VSM (vibrating sample magnetometer) was 1.8 T. From this value, the residual magnetic flux density (0.65 T) of the bond magnet according to Example 1B was 36% of the saturated magnetic flux density of the magnetic core. In the same manner, it was detected that: the residual magnetic flux density (0.75 T) of the bond magnet according to Example 2B was 42% of the saturated magnetic flux density of the magnetic core; the residual magnetic flux density (0.60 T) of the bond magnet according to Example 3B was 33% of the saturated magnetic flux density of the magnetic core; and the residual magnetic flux density (0.35 T) of the bond magnet according to Example 4B was 19% of the saturated magnetic flux density of the magnetic core. Also, the residual magnetic flux density (0.45 T) of the bond magnet according to Comparative Example 1B was 25% of the saturated magnetic flux density of the magnetic core, and the residual magnetic flux density (0.50 T) of the bond magnet according to Comparative Example 2B was 28% of the saturated magnetic flux density of the magnetic core.

Subsequently, a coil was wound (for 60 turns) around the gap of the magnetic core to form a winding area.

Thus, direct current reactors according to Examples 1R, 2R, 3R, and 4R were produced. A schematic structure of each of the direct current reactors produced as described above is shown in FIG. 1.

The direct current reactor 10 is formed of two substantially U-shaped cut cores (magnetic core) 11*a* and 11*b* opposed in a vertical direction in FIG. 1, a bond magnet 20 inserted and bonded in a gap 12 defined between the cut cores 11*a* and 11*b*, and winding areas 31*a* and 31*b* obtained by winding a coil 30 around an outer periphery of the bond magnet 20.

The bond magnet 20 is a rectangular parallelepiped having a thickness of 1 mm, a length of 25 mm, and a width of 16 mm. Magnetic fluxes (broken line arrows in FIG. 1) generated by the winding areas 31*a* and 31*b* are in reverse directions of magnetic fluxes (solid line arrows in FIG. 1) of the bond magnet 20.

Comparative Examples 1R and 2R

Direct current reactors according to Comparative Examples 1R and 2R were produced in the same manner as in the production of the direct current reactor according to Example 1R except for using the gap materials according to Comparative Examples 1B and 2B as the gap materials.

Comparative Example 3R

A direct current reactor according to Comparative Example 3R was produced in the same manner as in the production of the direct current reactor according to Example 1R except for using the gap material (glass epoxy resin) according to Comparative Example 3 as the gap material.

3. Evaluation and Discussion

By using each of the produced direct current reactors, a JIS-A noise was measured. Measurement conditions are as described below.

Each of the direct current reactors was suspended in a rectangular sound proof box that was shielded against external vibration from above the sound proof box, and an electric current (input: DC variable+ripple [triangle wave: 6.0 App (ampere peak to peak)]) was applied in a state where a coil was wound around the cut cores so as to prevent interference of vibration of the sound proof box. A noise meter was placed at a position distant from a surface of the cut cores by 100 mm, and noise generated from the direct current reactor was measured by the noise meter. The size of the sound proof box was 500 mm×500 mm×500 mm. A temperature in the sound proof box was 130° C.

More specifically, a noise measurement apparatus formed of the following devices was connected to a data recorder (external device) to measure a noise value and a current value.

(Devices Forming Noise Measurement Apparatus)

Function generator: product of HIOKI E.E. CORPORATION (type 7070)

Alternate current power amplifier: product of NF Corporation (type 4520)

Booster transformer: product of NF Corporation

High frequency wave CT: product of HIOKI E.E. CORPORATION (type 9275)

Noise meter: product of RION Co., Ltd. (type NL-20)

(Size: 500 mm×500 mm×500 mm)

Figure 2:
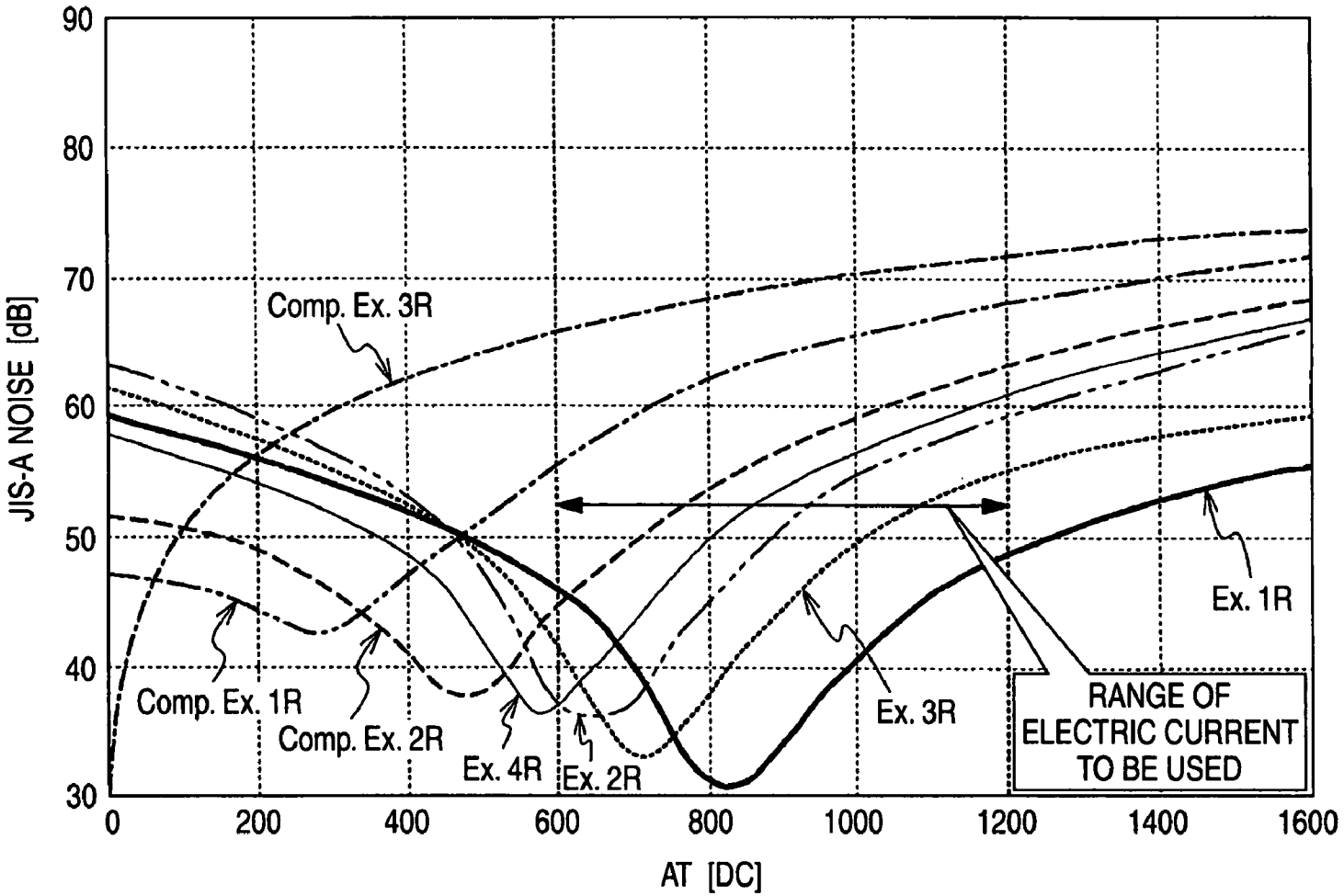
FIG. 2 is a diagram showing a relationship between magnetic field intensity AT and JIS-A noise (dB).

Noise/vibration meter unit: product of BK, PULSE acoustic vibration analysis device Ripple frequency during measurement: 10 kHz Shown in FIG. 2 is a relationship between magnetic field intensity (ampere turn (AT)) and JIS-A noise (dB).

According to FIG. 2, the followings are revealed. In a large electric current (AT) region where the direct current reactor is actually used, the direct current reactors according to Comparative Examples 1R and 2R using the bond magnet containing the sintered powder have low noise reduction effects. It is considered that the low noise reduction effects are attributable to reductions in coercive force and residual magnetic flux density under the high temperature. In contrast, it is apparent that the direct current reactors according to Examples are remarkably reduced in noise.

Such noise reduction is achieved since both of demagnetization resistance and a magnet bias effect are attained under the use environment owing to the use of the rapidly quenched powder of the rare earth magnet alloy as the magnet component of the bond magnet serving as the gap material. Also, in comparison among Examples, Examples 1R, 2R and 3R have the residual magnetic flux density that is within the range of 20% to 100% of the saturated magnetic flux density of the magnetic core used in the direct current rector and have the coercive force that is within the range of from 800 to 3200 kA/m. Therefore, Examples 1R, 2R, and 3R have the high noise reduction effects as compared to Example 4R.

Although the direct current rector bond magnets and the direct current reactors according to this invention have been described in the foregoing, this invention is not limited to the above-described modes of embodiments and examples at all, and various modifications are possible insofar as the modifications do not deviate from the scope of this invention. The present application is based on Japanese Patent Application No. 2008-035614 filed on Feb. 18, 2008 and Japanese Patent Application No. 2008-310354 filed on Dec. 5, 2008, the contents thereof being incorporated herein by reference.

What is claimed is:

1. A bond magnet for direct current reactor which is to be disposed in a gap formed in a magnetic core of a direct current rector, the bond magnet comprising a magnet powder comprising a rapidly quenched powder of a rare earth magnet alloy, the bond magnet having a residual magnetic flux density within a range of from 20% to 100% of a saturated magnetic flux density of the magnetic core used for the direct current reactor; and having a coercive force within a range of from 800 to 3200 kA/m.

2. The bond magnet according to claim 1, wherein the rare earth magnet alloy is at least one member selected from the group consisting of: a R—X1-X2 magnet alloy, wherein R is at least one rare earth element selected from the group consisting of Nd, Pr, Dy, Tb, and Ho, X1 is at least one element selected from the group consisting of Fe and Co, and X2 is at least one element selected from the group consisting of B and C; a Sm—Fe—N magnet alloy; and a Sm—Co magnet alloy.

3. The bond magnet according to claim 1, which has a recoil permeability of 1.1 or more.

4. The bond magnet according to claim 2, which has a recoil permeability of 1.1 or more.

5. A direct current reactor comprising a magnetic core having a gap, a winding area wound around the magnetic core and a bond magnet disposed in the gap of the magnetic core, wherein:

the bond magnet comprises a magnet powder comprising a rapidly quenched powder of a rare earth magnet alloy;

the bond magnet has a residual magnetic flux density within a range of from 20% to 100% of a saturated magnetic flux density of the magnetic core used for the direct current reactor; and the bond magnet has a coercive force within a range of from 800 to 3200 kA/m.

* * * * *